US005347699A

United States Patent [19]

Ward

[11] Patent Number: 5,347,699

[45] Date of Patent: Sep. 20, 1994

[54] PARTIAL CUT SHEARING DEVICE

[75] Inventor: Thomas A. Ward, Holts Summit, Mo.

[73] Assignee: ABB Power T&D Company Inc., Pa.

[21] Appl. No.: 989,224

[22] Filed: Dec. 11, 1992

[51] Int. Cl.[5] ..... B26D 3/00; B26D 5/20; B26F 3/00

[52] U.S. Cl. ..... 29/413; 29/414; 83/202; 83/584; 83/598; 83/601; 83/695; 225/2

[58] Field of Search ..... 83/582, 583, 598, 599, 83/601, 610, 611, 693, 695, 639.1, 584, 202, 257; 225/2, 94; 29/413, 414, 417, 426.4, 426.5

[56] References Cited

U.S. PATENT DOCUMENTS

| | | | |
|---|---|---|---|
| 351,024 | 10/1886 | Devero | 83/598 |
| 720,896 | 2/1903 | Cornelius et al. | 83/598 |
| 1,065,882 | 6/1913 | Lockwood | 83/598 X |
| 1,072,848 | 9/1913 | Hall et al. | 83/598 X |
| 3,570,356 | 3/1971 | Williams et al. | 83/693 |
| 4,241,631 | 12/1980 | Salvatore | 83/601 X |
| 4,416,176 | 11/1983 | Forthmann | 83/582 |
| 4,732,068 | 3/1988 | Yasuda et al. | 83/695 X |
| 4,785,696 | 11/1988 | Martiny | 225/94 X |

FOREIGN PATENT DOCUMENTS

| | | | |
|---|---|---|---|
| 125922 | 5/1919 | United Kingdom | 83/598 |

*Primary Examiner*—Eugenia Jones

*Attorney, Agent, or Firm*—Ostrolenk, Faber, Gerb & Soffen

[57] ABSTRACT

A device for partially shearing single or multiple sheets of material comprising a base having a recess and a lower blade fixed in the recess. A pair of movable blades having opposed ends are pivotally attached to the base at one end. A lost-motion connecting link connects the free ends of the pair of movable blades together and is connected to a hydraulic piston which moves the link a limited distance towards the base, thereby to rotate both movable blades relative to the fixed blade with a scissors-like action. When the pair of blades is moved towards the lower blade, the material is cut inward from both sides or edges of the material, leaving an inner uncut portion of material having a width which corresponds to the stroke of the movable blades.

4 Claims, 2 Drawing Sheets

PARTIAL CUT SHEARING DEVICE

BACKGROUND OF THE INVENTION

1. Field of the Invention

The present invention relates to a device for partially shearing thin, flat, hard material with opposing blades having zero clearance. More particularly, the invention relates to a device for cutting the material inward from both sides to leave an inner uncut portion of material.

2. Description of the Prior Art

In the manufacture of electrical power transformers, it is necessary to cut a large number of thin sheets of transformer laminations from a sheet or from a roll supply of, for example, amorphous steel transformer core material. Such cut laminations, which may be about 0.001 inch thick, are then stacked to form a transformer core.

There are many known devices for shearing such thin materials inwardly from an edge of the material. It is also known to use devices which cut material from both sides. Thus, U.S. Pat. Nos. 3,901,116 and 4,619,166 disclose double-bladed saws which advance inward from both sides to cut the material.

However, the above-mentioned devices completely cut the material from edge to edge, failing to leave an inner uncut portion. In modern processing, it is desirable to treat an entire sheet of material at once and, upon completion of processing, to separate the sheet into more manageable lengths for shipping or further processing.

The present invention provides an apparatus and method for partially shearing an entire sheet of material but leaving uncut tab portions which, upon completion of material processing, may be easily broken to separate the sheet into discrete lengths.

SUMMARY OF THE INVENTION

It is an object of the present invention to provide a device for partially shearing single or multiple sheets of material. In accordance with the invention, the device comprises a base having a recess with a lower blade fixed in the recess and a pair of movable blades having opposed ends which have zero clearance with the lower blade. One end of each of the movable blades is attached to the base and the other end is free. Means for connecting the free ends of the pair of movable blades together is located between the free ends to space the free ends from each other a predetermined distance wherein, when the pair of blades is moved towards the lower blade, the material is cut inward from both sides, leaving an inner uncut portion of material having a width which corresponds to the predetermined distance.

Another object of the present invention is to provide a shearing device for making a partial cut, as described above, which includes a biasing means which urges the cutting edges of the movable blades against the cutting edge of the lower blade so as to maintain minimal clearance between the cutting edges when the material is being cut, regardless of the thickness of the material.

A further object of the invention is to provide a shearing device which leaves an uncut tab disposed between partially cut lengths of the material. After the sheet of material has been treated, the tabs can be broken to separate the lengths.

Still a further object of the invention is to provide a method for partially shearing single or multiple sheets of material into lengths comprising the steps of driving a pair of movable blades towards a lower blade fixed in a base, cutting the material inward from both sides, to leave an inner uncut portion of material which corresponds to the predetermined distance.

Other features and advantages of the present invention will become apparent from the following description of the invention which refers to the accompanying drawings.

DETAILED DESCRIPTION OF THE PREFERRED EMBODIMENT

In accordance with the invention, the shearing device is capable of partially shearing single or multiple sheets of transformer steel material 18. For example, the device will cut amorphous magnetic material sheets which are extremely hard material, and are as thin as 0.001".

Figure 1:
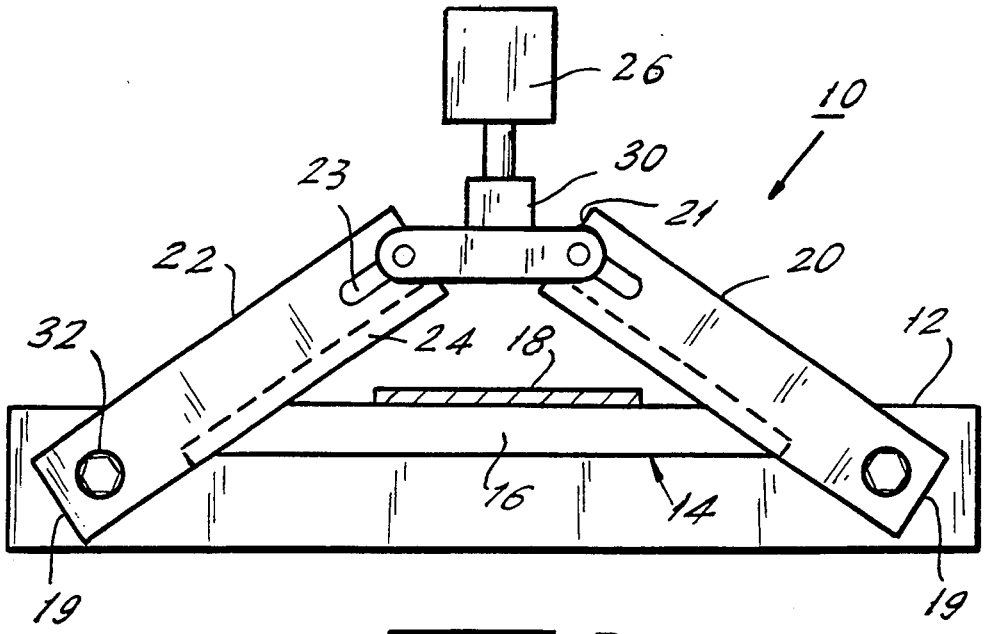
FIG. 1 is a front view of the partial cut shearing device of the present invention.
Figure 2:
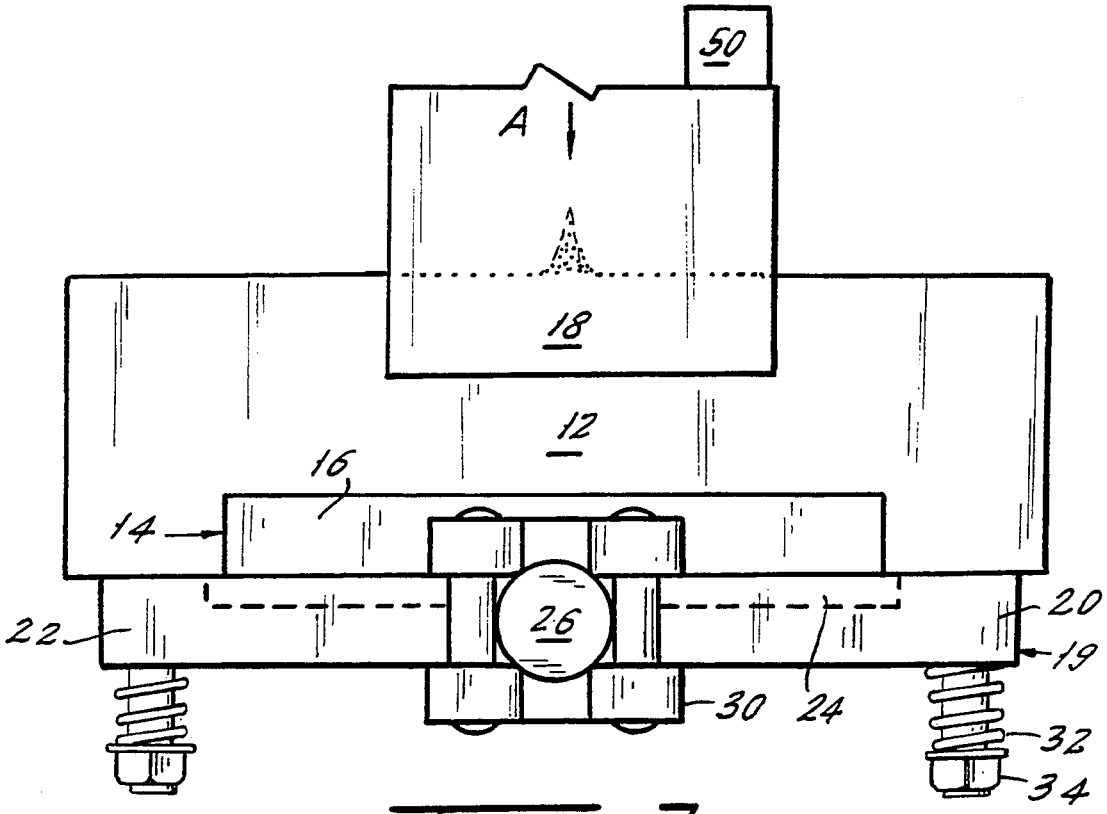
FIG. 2 is a top view of the device.

As depicted in FIG. 1, the device includes a base 12 having a rectangular recess 14 formed therein. A lower blade 16 is fixed in the recess, as shown in FIG. 2. The material 18 is fed along base 12 toward the cutting edge of blade 16 in the direction A in FIG. 2.

A pair of movable blades 20, 22 is attached to base 12 at their respective lower ends 19. Each blade includes a hardened cutting edge 24, designated by the dashed lines in FIGS. 1 and 2. The lower ends 19 are pivotally attached to the base 12 by respective bias assemblies 32 which urge the movable blades 20, 22 against lower blade 16 to maintain minimal or zero clearance between the cutting edges of movable blades 20, 22, and lower blade 16 when the material is being sheared.

Figure 3:
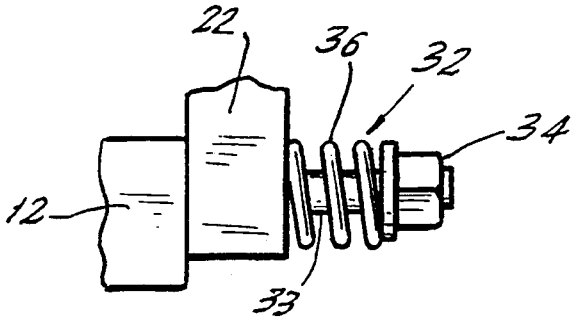
FIG. 3 is an enlarged view of the spring connection of the movable blades.

Referring to FIG. 3, each biasing assembly 32 comprises a shaft 33 extending from the base 12, with each shaft having a free threaded end. Shaft 33 extends from base 12 through its associated movable blade 20, 22. A spring 36 is provided on shaft 33. A nut 34 is disposed on the threaded end of shaft 33 to compress and secure the spring 36 against the outside surface of the movable blade.

When a sheet of material 18 is being partially sheared by the movable blades 20, 22 and lower blade 16, the material tends naturally to separate the blades by a distance at least equal to the thickness of the material. However, spring 36 provides a biasing force against the respective movable blade to urge the cutting edges of the movable blades against the cutting edge of the lower blade, resulting in zero or minimal clearance therebetween. Therefore, the present invention can be used to partially shear varying thicknesses of material, ranging from a very thin sheet of material to multiple sheets of thick material.

As shown in FIG. 1 and 2, the upper end 21 of each movable blade 20, 22 is free to rotate in relation to base 12. Each end 21 includes a lost-motion slot 23. A connecting means 30 is located between the free ends 21 and is movable in slots 23.

In accordance with the invention, the movable blades can be driven downward a given distance to move blades 20, 22 toward lower blade 16. The driving force can be supplied by a hydraulic cylinder 26. A suitable stop (not shown) can adjustably limit the stroke of the plunger of cylinder 26. When the movable blades are driven toward lower blade 16, the material or web 18 is cut inward from both sides leaving the inner uncut portion 40. Uncut portion 40 typically may have a length of 3/8 inch. The length of uncut portion 40 can be adjusted by changing the length of the stroke of cylinder 26 or the length of the plunger.

Figure 4:
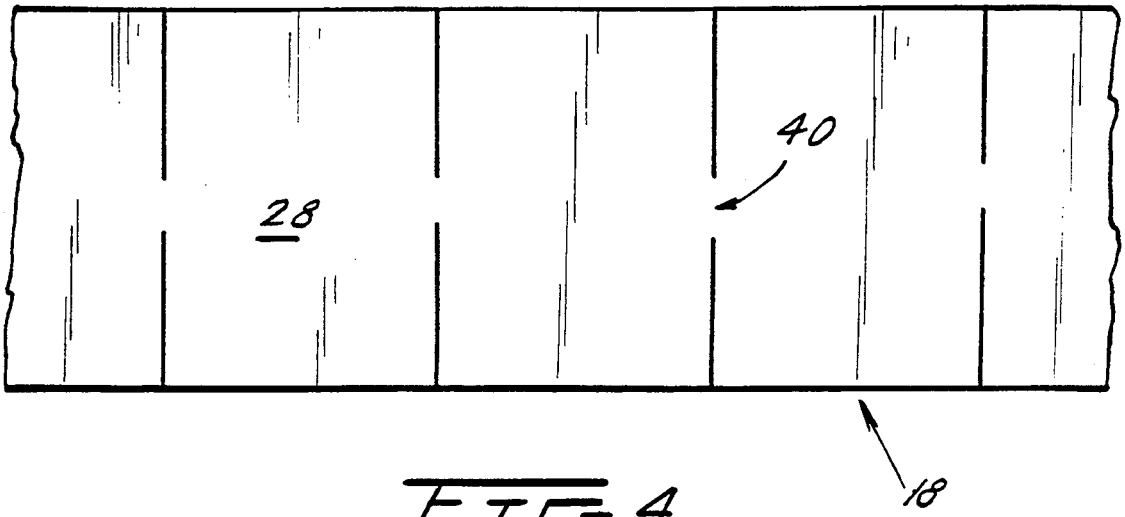
FIG. 4 is a top view of a sheet of material partially sheared by the device of the present invention.

As shown in FIG. 4, the uncut portion comprises a tab 40 disposed between partially cut lengths 28 of the material 18. The tab allows the material to be further processed as a strip, for example, for annealing, cleaning, or the like. After processing, the tab 40 is broken or slit and the material is easily separated into lengths 28 which are stacked to form a core for a transformer.

In accordance with the invention, the material to be cut may be moved intermittently into position between the blades to partially cut the sheets of material into discrete lengths. As shown in FIG. 2, an actuator 50, provided for this purpose, steps the material 18 toward the blades at intervals corresponding to the desired dimensions of the finished lengths 28.

In operation, actuator 50 has means to grip and move web 18 to a rest position between lower blade 16 and upper movable blades 20, 22. When the hydraulic cylinder 26 is actuated, connecting link 30 moves downward, thereby moving blades 20, 22 downward simultaneously. Web 18 is cut through a scissor-type motion inward from both sides. However, due to an incomplete cutting stroke, the inner uncut portion 40 remains in the center of the material. Blades 20, 22 then return to their original position, and actuator 50 again steps the material 18 a distance, corresponding to the desired length 28 to make a new incomplete cut.

The sheet of material is then further processed, with all sections or laminations held together by the uncut tabs. Upon the completion of processing, the uncut tab portions 40 can be easily broken to separate the material into lengths 28.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A method for partially shearing material into lengths, comprising the steps of:

driving a pair of movable blades, each having opposed ends, towards a lower blade fixed in a base with scissors-like action, one end of each of said movable blades being pivotally attached to said base and the other ends being free to rotate relative to said base, the free ends of said pair of movable blades being connected together by a link having first and second ends slidably disposed in respective slots in said pair of mobile blades, said link simultaneously rotating said pair of blades toward said base when said link is moved toward said base;

moving said link toward said base until opposite side edges of said material are simultaneously engaged by respective ones of said pairs of blades;

cutting said material inward from both sides by continuing to move said pair of movable blades toward said base for a limited distance to leave an inner uncut portion of material having a width which corresponds to said limited distance;

urging said movable blades against said lower blade so as to maintain minimal clearance therebetween when the material is being cut, one end of each of said movable blades being pivotally attached to said base by biasing means for urging the movable blades against said lower blade;

intermittently step-feeding the material into cutting position on said base between the movable blades and fixed blade to partially cut the sheet of material into a plurality of joined lengths; and breaking the uncut portion to separate the lengths of material, after the material has been treated in a further treatment step.

2. A device for partially shearing a material, comprising:

a base;

a lower blade fixed to said base;

a pair of movable blades having opposed ends, one end of each of said movable blades being pivotally attached to said base and the other end being free to rotate relative to said base;

lost-motion connecting means for connecting the free ends of said pair of movable blades together, said connecting means comprising a link which has first and second ends slidably disposed in respective slots in said free ends of said pair of movable blades, said link being operable to simultaneously rotate said pair of blades toward said base when said link is moved toward said base;

means for moving said link toward said base until the opposite side edges of said material are simultaneously engaged by respective ones of said pair of blades, and for continuing to move said pair of blades for a limited distance such that said pair of blades is moved towards said lower blade with a scissors-type action, and the material is cut inward from both sides to leave an inner uncut portion of material having a width which is determined by said limited distance;

biasing means for pivotally attaching said one end of each of said pair of movable blades to said base, wherein said biasing means urges said movable blades against said lower blade so as to maintain minimal clearance therebetween when the material is being cut, regardless of the thickness of the material; and means for intermittently advancing said material into cutting position on said base to partially cut the material into a plurality of joined lengths.

3. The device of claim 2, wherein said means for moving comprises a hydraulic cylinder.

4. The device of claim 2, wherein said uncut portion has a length of about 3/8 inch.

* * * * *